United States Patent [19]

Orak

[11] Patent Number: 4,632,391

[45] Date of Patent: Dec. 30, 1986

[54] PORTABLE EXERCISING DEVICE

[76] Inventor: Zeki Orak, 68 Cumberland, San Francisco, Calif. 94110

[21] Appl. No.: 598,206

[22] Filed: Apr. 9, 1984

[51] Int. Cl.[4] ..... A63B 21/22

[52] U.S. Cl. ..... 272/128; 272/67; 446/170

[58] Field of Search ..... 272/128, 143, 117, 93, 272/67, 68, 122, 123, 124; 446/170

[56] References Cited

U.S. PATENT DOCUMENTS

| | | | |
|---|---|---|---|
| 1,333,005 | 3/1920 | Warner | 272/143 X |
| 2,466,116 | 4/1949 | Marong . | |
| 3,901,503 | 8/1975 | Klose | 272/128 X |
| 4,029,312 | 6/1977 | Wright | 272/123 |
| 4,356,915 | 11/1982 | Phillips | 446/170 X |
| 4,480,831 | 11/1984 | Muller-Deinhardt | 272/128 |

FOREIGN PATENT DOCUMENTS

| | | | |
|---|---|---|---|
| 2519214 | 11/1976 | Fed. Rep. of Germany | 272/119 |
| 1208935 | 9/1959 | France | 272/128 |

*Primary Examiner*—Richard J. Apley
*Assistant Examiner*—Robert W. Bahr
*Attorney, Agent, or Firm*—Limbach, Limbach & Sutton

[57] ABSTRACT

A portable exercising device is disclosed having a toroidally shaped inner chamber. A free moving body is disposed within the chamber. In use, the free moving body is placed into rotation within the chamber. The angular momentum of the body provides a resistance to motion to enhance the exercising effects. In the preferred embodiment, the device is ring-shaped and includes an elongated handle mounted through a center aperture. The device may also be used as a muscle tension reliever and as a coordination developer.

5 Claims, 3 Drawing Figures

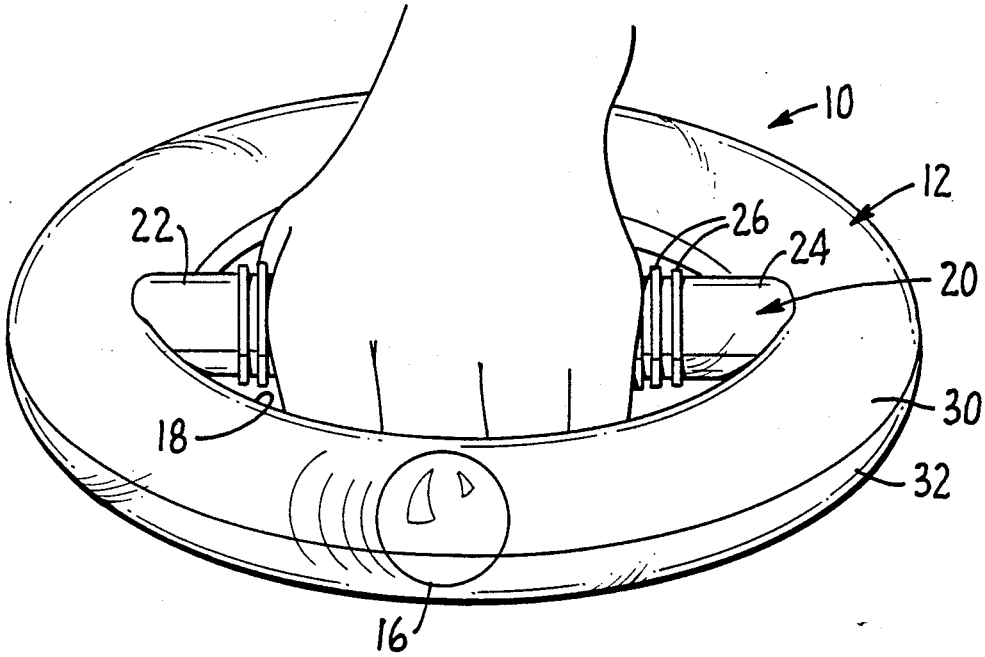
FIG. 1.
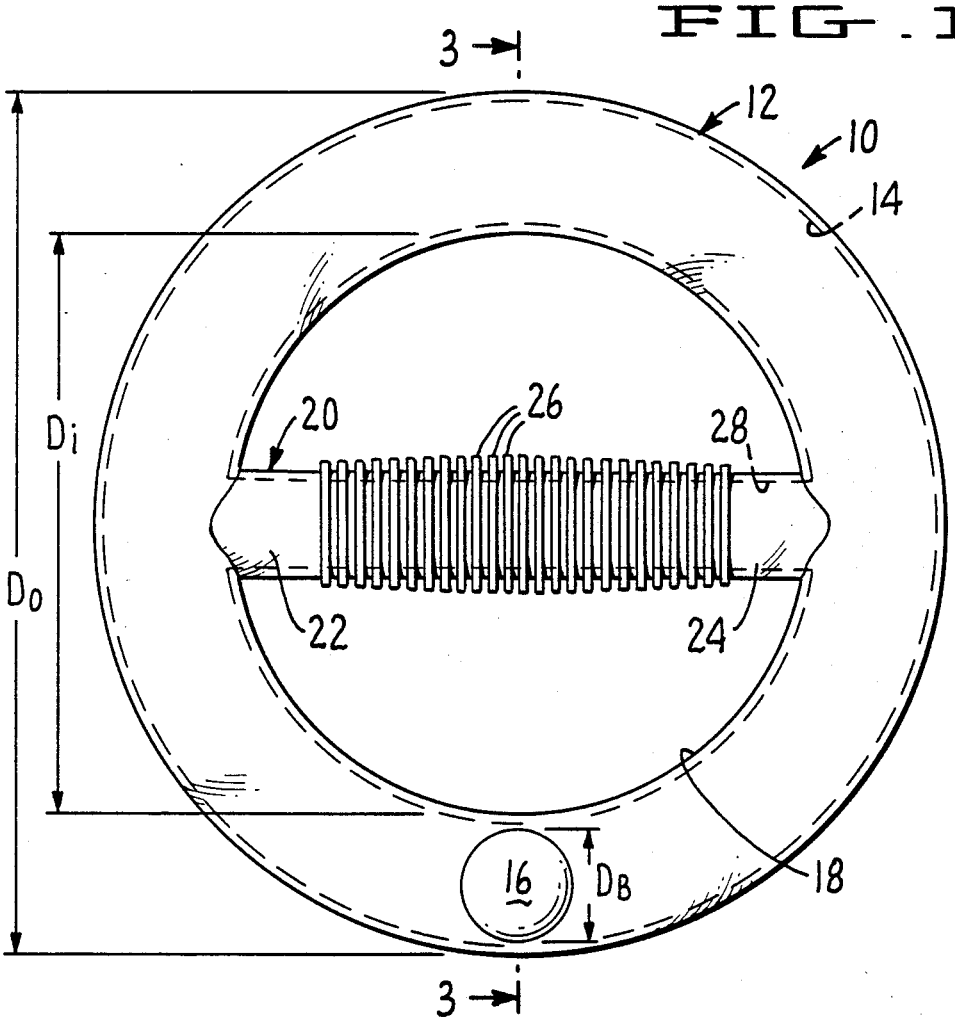
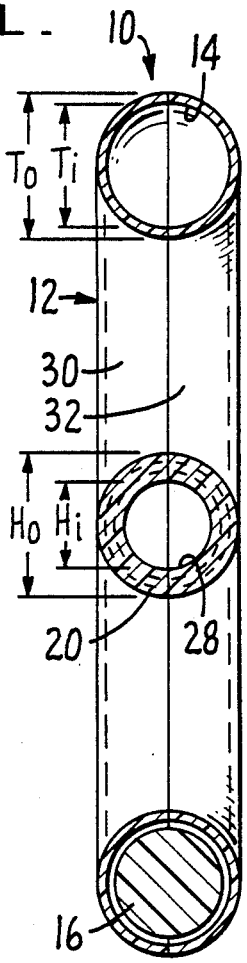
FIG. 2.
FIG. 3

PORTABLE EXERCISING DEVICE

DESCRIPTION

1. Technical Field

The present invention relates to a portable exercising device by which the user acts against the angular momentum of a free moving body rotating about the toroidal inner chamber of the device.

2. Background of the Invention

Many forms of exercise equipment have been developed in the prior art. Much of the equipment is relatively heavy or bulky, such as universal gyms and free weights. Due to their bulk and weight, these devices are not portable.

Although portable, lightweight devices have been known to exist, they generally do not provide a sufficient workout as they typically are simple weights merely scaled down to portable size. These include ankle, hand and wrist weights, weighing only a few pounds.

Thus, a user of such conventional exercising devices is often faced with the choice of operating heavy equipment or settling for less than a sufficient workout by using the heretofore known portable devices.

It is, therefore, an object of the present invention to provide an exercising device that is portable and yet provides a satisfactory workout.

It is another object of the present invention to provide a device to improve coordination between the right and left sides of the body.

It is a further object of the present invention to provide a device to relieve muscle tension.

SUMMARY OF THE INVENTION

An exercising apparatus is disclosed comprising a hollow ring having a generally toroidally shaped inner chamber defining a closed path. A free moving body is disposed within the inner chamber. A handle means is provided extending across the opening in the ring.

In use, the free moving body is placed into rotation within the chamber. The angular momentum of the body provides a resistance to motion which enhances the exercising effect.

The invention is described below in greater detail with reference to the accompanying drawings which depict different views of a device of the present invention.

BRIEF DESCRIPTION OF THE DRAWINGS

FIG. 1 is a perspective view of the device in the operational position in which the free moving body is set in motion about the circular path by forces applied by the user.

FIG. 2 is a top plan view of the device.

FIG. 3 is a cross-sectional view of the device taken along lines 3—3 of FIG. 2.

BEST MODE FOR CARRYING OUT THE INVENTION

In the drawings, the subject device is shown generally as numeral 10. As shown in FIG. 2, the device is comprised of a member 12 having a toroidally shaped inner chamber 14. Chamber 14 defines a closed path within which is housed a free moving body 16. In operation, the user grips the device 10 and sets the free moving body into continuous motion in a direction, clockwise or counter-clockwise, within toroidal inner chamber 14. This may be accomplished by moving the entire device in a circular manner.

In the illustrated embodiment of the present invention, member 12 is a hollow ring having a central opening 18 as shown in FIGS. 1 and 2. Preferably, member 12 is formed from a light weight material, such as ordinary plastic, to enhance the device's portability. The plastic should be generally transparent, to permit a user to visually observe his progress and skill in operating the device.

Gripping may further be facilitated by the inclusion of a handle 20 connected to member 12 as shown in FIGS. 1 and 2. Handle 20 may be of a generally tubular configuration disposed across central opening 18 and connected to member 12 at the opposed ends 22 and 24 thereof. As shown in FIGS. 2 and 3, handle 20 is hollow and defines a tubular inner chamber 28 which may in turn be continuous with toroidal inner chamber 14.

Preferably, the opposed ends of handle 20 are tapered to facilitate gripping. Furthermore, handle 20 may also be provided with a plurality of ridges 26 about its outer surface to provide a secure gripping surface. As shown in FIG. 2, the amount ridges 26 project from handle 20 progressively decreases from the center of handle 20 out towards the opposed ends.

Free moving body 16 may be of any configuration so long as its ability to rotate about toroidal inner chamber 14 is unhindered. For example, body 16 may be configured as a segment of a ring. In the illustrated embodiment, body 16 has a spherical configuration. Body 16 is comprised of a relatively dense substance such as stainless steel. Body 16 should be comprised of a substance of greater density than that of member 12. It is also preferable that free moving body and member 12 are comprised of substances which create sound upon rotation. Where handle 20 is of a hollow tubular configuration, free moving body 16 is provided with dimensions to prevent it from entering tubular inner chamber 28 and yet allow free rotation within toroidal inner chamber 14.

In the preferred embodiment, member 12 is a hollow ring having a uniform thickness of approximately 1.5 mm. The outer diamater $D_o$ is approximately 222 mm and inner diameter $D_i$ is approximately 148 mm. Toroidal inner chamber 14 has an outer diameter $T_o$ of approximately 37 mm and an inner diameter $T_i$ of approximately 34 mm. Free moving body 16 may be formed from a smooth, chrome-plated steel sphere having a diameter $D_b$ of approximately 32 mm and weighing approximately five ounces. Handle 20 is a hollow cylindrical tube having a uniform thickness of approximately 1.5 mm and a length spanning the diameter of central opening 18. Tubular inner chamber 28 of handle 20 has an outer diameter $H_o$ of approximately 31 mm and an inner diameter $H_i$ of approximately 28 mm. Ridges 26 at their greatest height project approximately 4.5 mm over the outer surface of handle 20.

To facilitate manufacture, device 10 may be formed from two complementary, opposed segments 30 and 32. During assembly, these segments may be joined by any suitable means, such as gluing or ultrasonic welding.

In use, the angular momentum of free moving body 16 increases with the speed of rotation. As the angular momentum increases, it becomes increasingly difficult for the user to disturb the plane of rotation of the free moving body. Thus, the user must exert more force to rotate the plane of the device when the free moving body is in rotation than when it is stationary. This feature is an advantage over the prior art exercise devices involving free weights and the like which require their users to expend energy only in relation to the weight of the device. A user of such prior art conventional weight devices must exert the same amount of energy to simply carry the device as he would to use it in an exercise program. Those devices tend to be quite cumbersome because of their great bulk and weight.

The device of the present invention is not so limited and is quite portable and compact by comparison. The energy expended by a user in carrying the device is a mere fraction of that expended in the course of an exercise program. Thus, a user may carry the device with him and have it available for use at his leisure.

The device of the present invention may further be used as a tension relief apparatus. This advantage may be realized in two ways. As can be appreciated, to keep body 16 in rotation, a good deal of concentration is required. This type of concentration can divert the user's attention from stress related thoughts. In addition, in use, free moving body 16 creates a rhythmic vibration throughout member 12. A user may exploit the rhythmic phenomenon to massage or soothe areas of physical tension by placing the operating device near the tense area, such as the forehead or temple region.

The device may further be used to improve coordination of the user. For example, two devices may be used at a time with one held in each hand. The sound generated by operating the device in each hand may be used to gauge the relative speeds of rotation and location of the moving body. Where the sound emanating from the right and the left hands is different, the user can adjust the speed of rotation until synchronicity is achieved. This type of exercise aids in developing bi-lateral coordination.

Although the foregoing invention has been described in some detail by way of illustration and example for purposes of clarity of understanding, it will be obvious that certain changes and modifications may be practiced within the scope of the appended claims.

I claim:

1. An exercise apparatus comprising:

a toroidal member having a circular cross-section of a diameter to facilitate gripping, said member further having a sealed uniform inner chamber of circular cross-section;

an elongated handle extending linearly across the toroidal member and connected thereto to provide an alternate gripping means; and a spherical body located within said sealed inner chamber, with the diameter of said spherical body being slightly less than the diameter of the chamber to produce continuous sound upon rotation thereby permitting the user to gauge the speed of rotation of said body, and with said body having a fixed weight and a density greater than the material forming the toroidal member such that at rest, the apparatus is easy to carry, but upon rotation, the angular momentum of the body is sufficient to create resistance to movement in the plane of rotation of the body thereby providing exercise.

2. An apparatus according to claim 1 wherein said member is comprised of a substantially transparent material.

3. An apparatus according to claim 1 wherein the opposite ends of said handle are tapered.

4. An apparatus according to claim 1 wherein the outer surface of said handle includes a plurality of ridges to provide a secure gripping surface.

5. An apparatus according to claim 1 wherein said free moving body is formed from steel.

* * * * *